US007984842B2

(12) United States Patent
Richie

(10) Patent No.: US 7,984,842 B2
(45) Date of Patent: Jul. 26, 2011

(54) MEGAPHONE POPCORN CUP

(76) Inventor: Jon A. Richie, Minnetonka, MN (US)

( * ) Notice: Subject to any disclaimer, the term of this patent is extended or adjusted under 35 U.S.C. 154(b) by 576 days.

(21) Appl. No.: 12/024,385

(22) Filed: Feb. 1, 2008

(65) Prior Publication Data

US 2008/0185424 A1 Aug. 7, 2008

Related U.S. Application Data

(60) Provisional application No. 60/888,010, filed on Feb. 2, 2007.

(51) Int. Cl.
*B65D 3/28* (2006.01)
*G10K 11/18* (2006.01)

(52) U.S. Cl. ..... 229/103; 181/178; 181/180; 229/5.5; 229/400

(58) Field of Classification Search ..... 229/5.5, 229/103, 122, 31, 183, 400, 104; 181/177, 181/178, 180
See application file for complete search history.

(56) References Cited

U.S. PATENT DOCUMENTS

| | | | | | |
|---|---|---|---|---|---|
| 496,131 | A | * | 4/1893 | Peirce | 229/400 |
| 677,017 | A | * | 6/1901 | Carrington | 229/104 |
| 1,009,463 | A | * | 11/1911 | Bloomer | 229/104 |
| 1,295,418 | A | * | 2/1919 | Bohlman | 229/400 |
| 1,300,164 | A | * | 4/1919 | Guardino | 229/104 |
| 2,113,715 | A | * | 4/1938 | Wilcox | 229/5.5 |
| 2,507,843 | A | | 5/1950 | Wheeler | 229/1.5 |
| 3,137,431 | A | | 6/1964 | Crouse et al. | 229/1.5 |
| 3,226,000 | A | | 12/1965 | Poole et al. | 229/1.5 |
| 3,739,975 | A | * | 6/1973 | Davidow | 229/116.3 |
| 3,924,795 | A | | 12/1975 | Smith | 229/4.5 |
| 4,011,983 | A | * | 3/1977 | Greene | 229/104 |
| 4,125,218 | A | | 11/1978 | DeBoer | 229/1.5 B |
| D271,968 | S | | 12/1983 | Segan et al. | D14/35 |
| D275,438 | S | | 9/1984 | Everson | D7/9 |
| D283,772 | S | | 5/1986 | Vail | D7/9 |
| 4,613,012 | A | | 9/1986 | Mueller, III | 181/178 |
| 4,618,066 | A | | 10/1986 | Vail | 215/12 |
| 4,838,431 | A | | 6/1989 | Sanz et al. | 206/631 |
| 5,076,433 | A | | 12/1991 | Howes | 206/459 |
| 5,094,317 | A | | 3/1992 | Ladendorf | 181/178 |
| D333,409 | S | | 2/1993 | Dietzmann | D75/7 |
| 5,501,363 | A | | 3/1996 | Muller et al. | 220/630 |
| 5,967,405 | A | | 10/1999 | Hanauska | 229/103 |
| 2005/0145594 | A1 | * | 7/2005 | Dorsey et al. | 215/378 |

FOREIGN PATENT DOCUMENTS

GB 2130565 A * 6/1984

OTHER PUBLICATIONS

Various Collector cups publicly available prior to Feb. 2, 2007.

* cited by examiner

*Primary Examiner* — Gary E Elkins
(74) *Attorney, Agent, or Firm* — David D. Brush; Westman, Champlin & Kelly, P.A.

(57) ABSTRACT

A megaphone popcorn cup is provided. The cup includes a first end, which is open to an interior of the cup, and a second end, which has a smaller diameter than the first end. The cup has a side wall with overlapping first and second side edges that are attached to one another. An end cap at least partially seals the second end. The end cap is vertically offset from the second end toward the first end and is formed with the side wall as a single, continuous piece of material.

7 Claims, 4 Drawing Sheets

MEGAPHONE POPCORN CUP

CROSS-REFERENCE TO RELATED APPLICATION

This application claims the benefit of U.S. Provisional Application No. 60/888,010, filed Feb. 2, 2007 and entitled "Megaphone Popcorn Cup, which is hereby incorporated by reference in its entirety.

FIELD OF THE DISCLOSURE

The present disclosure relates to food concession containers, such as cups. More particularly, the present disclosure relates to food concession containers used at sporting and other events.

BACKGROUND

At sporting events, popcorn and other food items are typically distributed to customers in containers, such as cups, bags and boxes. For example, popcorn is typically sold in a bag that can be carried by a customer attending the event.

In the early days of professional baseball and football, popcorn cups were used. These cups served as both a container for the popcorn and a megaphone for cheering at the event. These cups had a generally conical shape with the small, narrow end being open (with a small diameter opening) or closed by an end cap. The end caps were fixed to the conical cup by a friction-fit with metal ring so that the end caps could be removed after the popcorn had been consumed. The cup could then be used as a megaphone.

Unfortunately, these types of cups became extremely expensive to manufacture and are no longer in use. Presently, popcorn is most often distributed in a bag. Some manufactures sell plastic cups with plastic, snap-on end caps or bases. The end caps or bases can be removed so that the remaining container can be used as a megaphone. But again, these cups can be expensive to manufacture.

Improved food containers are therefore desired that are relatively inexpensive and easy to make and that bring back the nostalgia of early sporting events.

SUMMARY

An aspect of the disclosure relates to a container. The container includes a first end, which is open to an interior of the container, and a second end, which has a smaller diameter than the first end. The container has a side wall with overlapping first and second side edges that are attached to one another. An end cap at least partially seals the second end. The end cap is vertically offset from the second end toward the first end and is formed with the side wall as a single, continuous piece of material.

Another aspect of the disclosure relates to an article of manufacture that includes a sheet of material. The sheet of material includes first and second side edges and curved top and bottom edges. The top and bottom edges have lengths and radii of curvature such that the sheet of material forms a three-dimensional terminated cone with substantially parallel top and bottom ends when the first and second side edges are overlapped with one another. An end cap is connected to the bottom edge through a bridge, wherein the bridge extends along only a portion of the bottom edge.

In one example, the container forms a conical megaphone popcorn cup.

DETAILED DESCRIPTION OF ILLUSTRATIVE EMBODIMENTS

Figure 1:
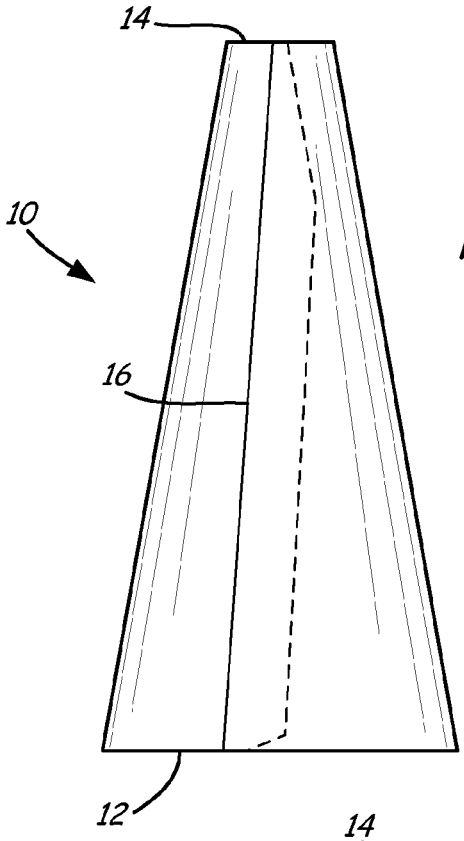
FIGS. 1 and 2 are side and perspective views, respectively, of an assembled food container according to an aspect of the disclosure.
Figure 2:
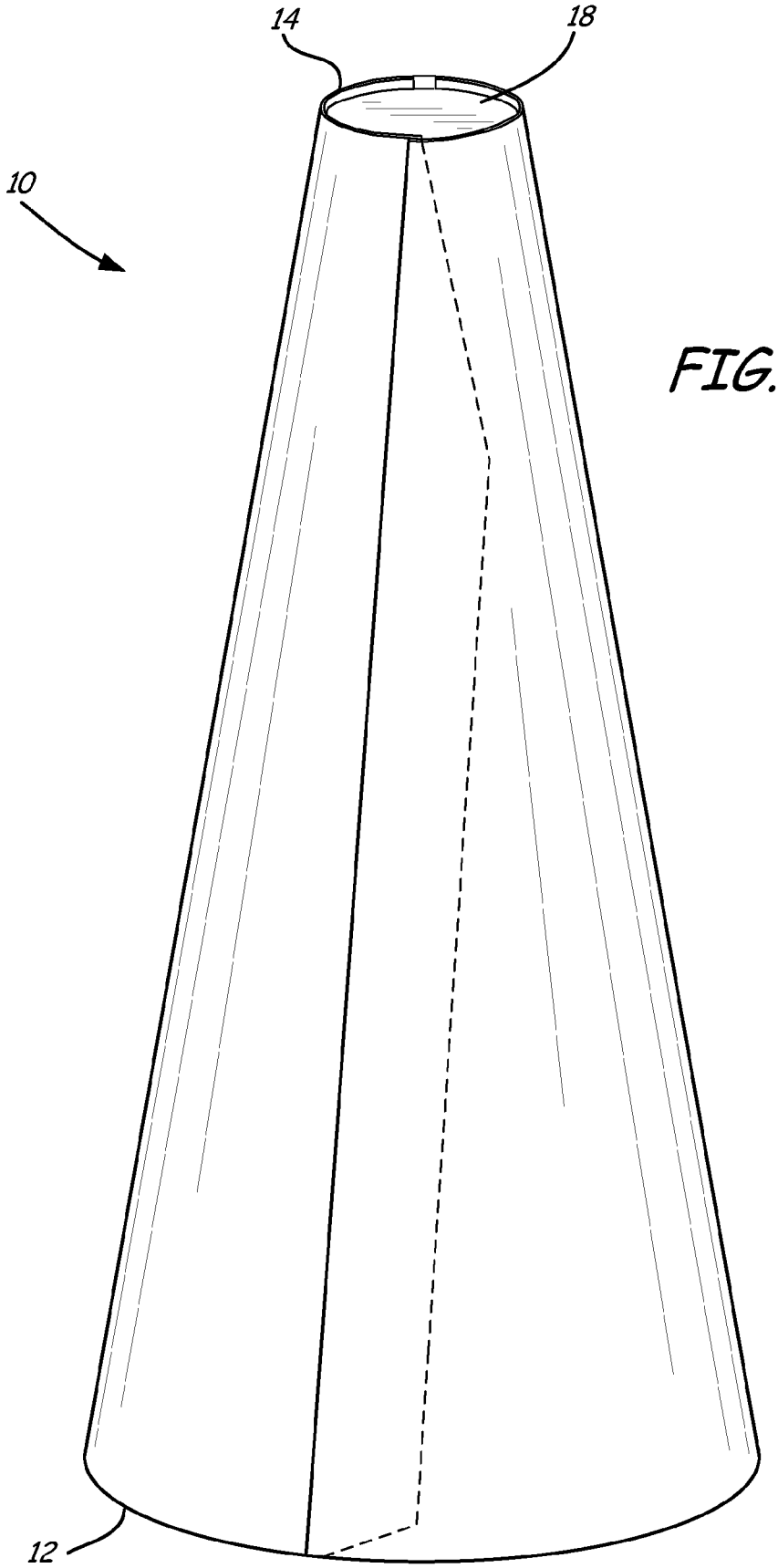

FIGS. 1 and 2 are side and perspective views, respectively, of a food container 10 according to an exemplary aspect of the disclosure. Container 10 has a generally conical shape with an open, large-diameter end 12 and a closed, small-diameter end 14. The large diameter end 12 is open to an interior of container 10 so that container 10 can be used as a cup to hold popcorn or other food or beverage items, for example. When used to contain food, container 10 is oriented vertically with large diameter end 12 serving as an open top and small diameter end 14 serving as a closed bottom.

Container 10 can be made from any suitable material, such as but not limited to paper, plastic, etc. or a combination thereof. In one exemplary embodiment, container 10 is formed from a planar sheet of material that has been rolled into a cone, with the two side edges of the sheet overlapping one another to form a seam 16. Seam 16 can be secured by any suitable method or material, such as by an adhesive positioned between the two edges. In other examples, the seam can be secured by adhesive tape and/or one or more staples, for example.

The small-diameter end 14 is closed by an end cap 18 that can be formed as a single-continuous piece with the material forming the remainder of the conical container or as a separate piece that is attached to the container such as along the inner diameter face of the container, the outer diameter face of the container, and/or along the edges of end 14.

Figure 3:
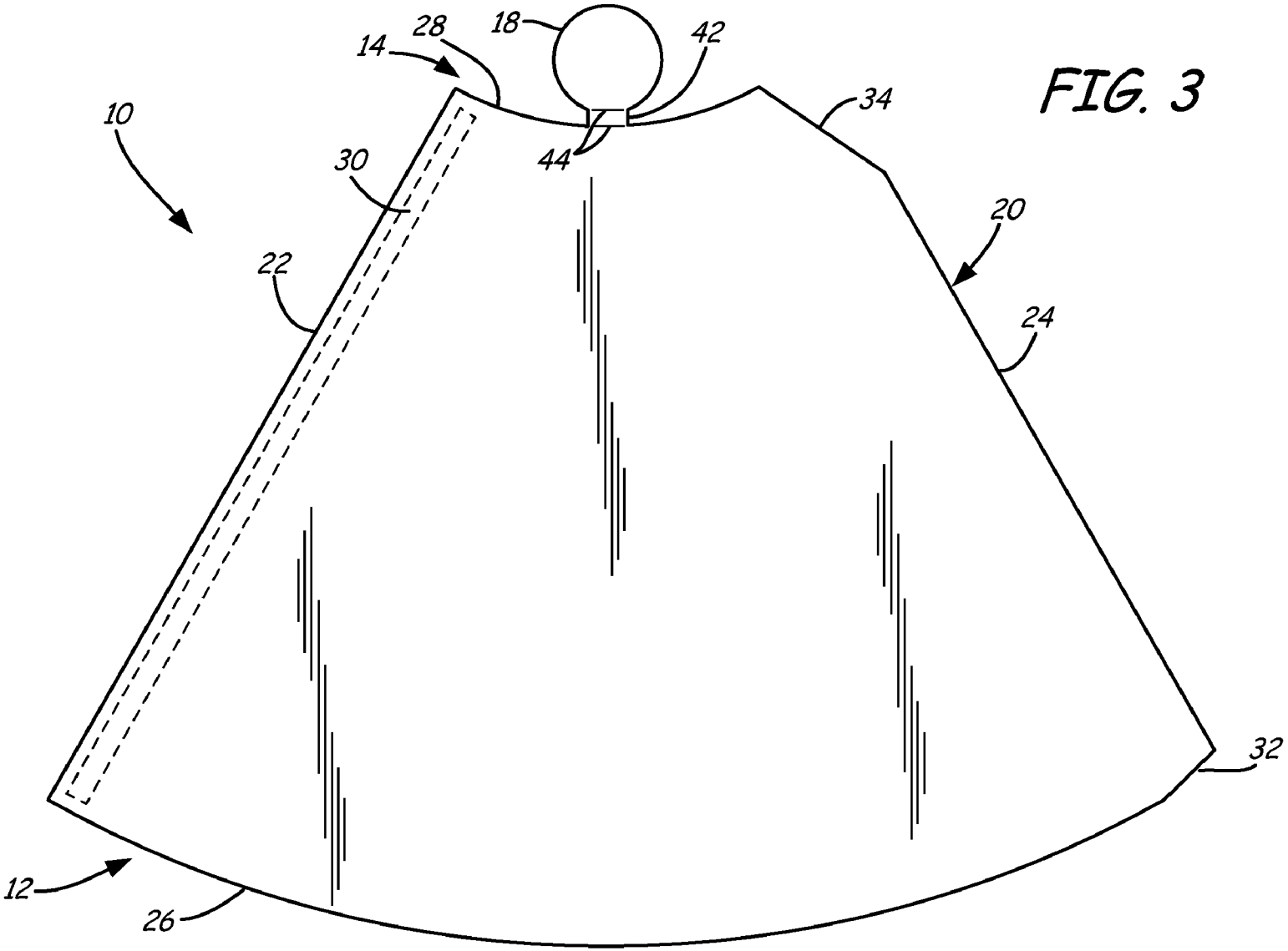
FIG. 3 is a plan view of the container prior to assembly, according to an exemplary aspect of the disclosure.

FIG. 3 is a plan view of an article of manufacture for container 10 prior to assembly, according to an exemplary embodiment of the disclosure. Container 10 is assembled from a planar sheet 20 having side edges 22 and 24 and top and bottom edges 26 and 28. Top and bottom edges 26 and 28 form ends 12 and 14, respectively. Sheet 20 has a shape resembling a trapezoidal with curved edges 26 and 28. Curved edges 26 and 28 have lengths and radii such that when sheet 20 is rolled so that side edge 22 slightly overlaps side edge 24, the sheet forms a three-dimensional terminated cone with substantially parallel top and bottom ends. Top edge 26 has a greater radius of curvature than bottom edge 28.

In one embodiment, an adhesive strip 30 (shown in dashed lines) can be attached to the inside surface of sheet 20 along at least a portion of edge 22 such that the strip contacts and adheres to the outside surface of the sheet along edge 24. Side edges 22 and 24 can have rectilinear shapes and/or curved shapes, for example. Adhesive can also or alternatively be attached to the inner diameter surface of edge 24. In one embodiment, the adhesive strip further includes a releasable liner to allow multiple articles of manufacture to be stacked prior to assembly without sticking to one another.

In the example shown in FIG. 3, edge 24 has a pair of cut-outs 32 and 34, which assist in the forming operation during assembly. The cutouts allow the edges 22 and 24 to be more easily overlapped and provide a flatter surface for the cone once the edges are mated.

Bottom edge 28 includes end cap 18, which is connected to the edge through bridge piece 42, which provides a vertical offset as described in more detail below. Bridge piece 42 has breaks 44 along each end to encourage bending along the breaks during assembly. Breaks 44 can be made by pre-bending the material of sheet 20 or by any other method such as by perforating or weakening the material along edge 28 and end cap 18. In an alternative embodiment, end cap 18 is attached to edge 28 without bridge piece 42.

In the example shown in FIG. 3, end cap 18 has a circular shape, but can have other shapes in other embodiments, such as any curved shape or any rectilinear shape. For example, end cap 18 may be oval or rectangular. If desired, the shape of end cap 18 can be selected to match the cross-sectional shape of container 10 along its inner diameter when the container is assembled.

Figure 4:
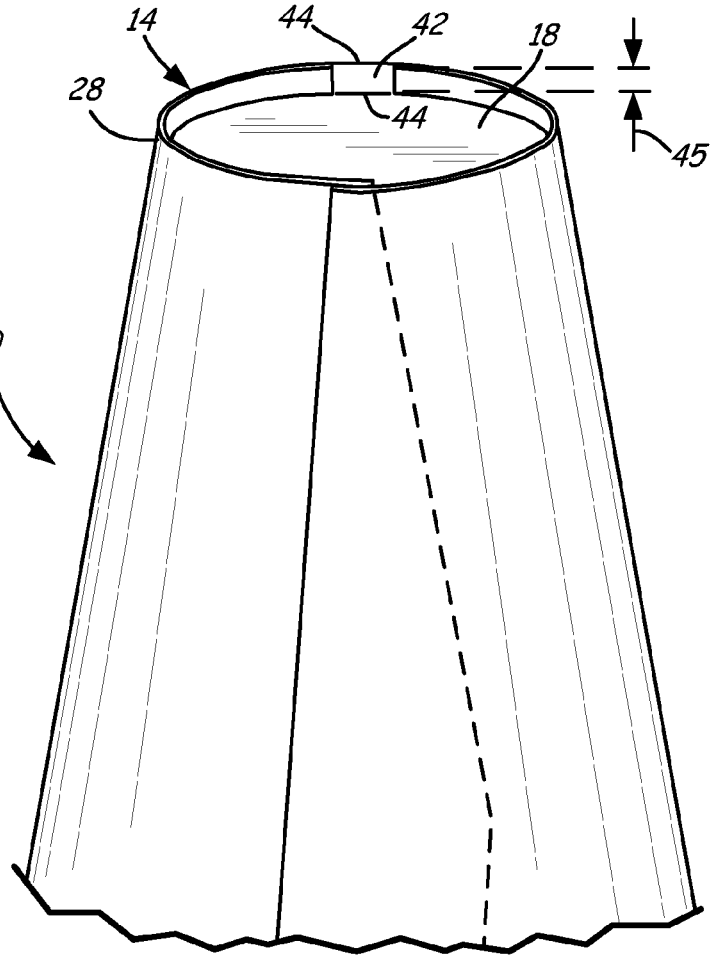
FIG. 4 is an enlarged fragmentary view of an end of the assembled container shown in FIGS. 1-2, according to an exemplary aspect of the disclosure.

FIG. 4 is an enlarged fragmentary view of end 14 of container 10 after assembly, according to an exemplary embodiment of the disclosure. As shown in FIG. 4, end cap 18 at least partially seals the opening in end 14 after assembly. In this embodiment, the outer diameter of end cap 18 mates with the inner diameter surface of the cone formed by container 10. Bridge piece 42 is bent along breaks 44 so that end cap 18 is vertically offset, as shown by arrows 45 from edge 28 in a direction toward the large-end 12 (shown in FIG. 1). This can provide the look of a more traditional cup.

In one example, end cap 18 has a diameter that is larger than an inner diameter of container 10 at bottom edge 28 and smaller than the inner diameter of container 10 at top edge 26. The end cap 18 frictionally engages an inner diameter surface of the container's side wall without any further attachment to the inner diameter surface. The smaller diameter bottom edge 28 tends to hold end cap 18 in place when the end cap of forced downward by food contained within he container.

Figure 5:
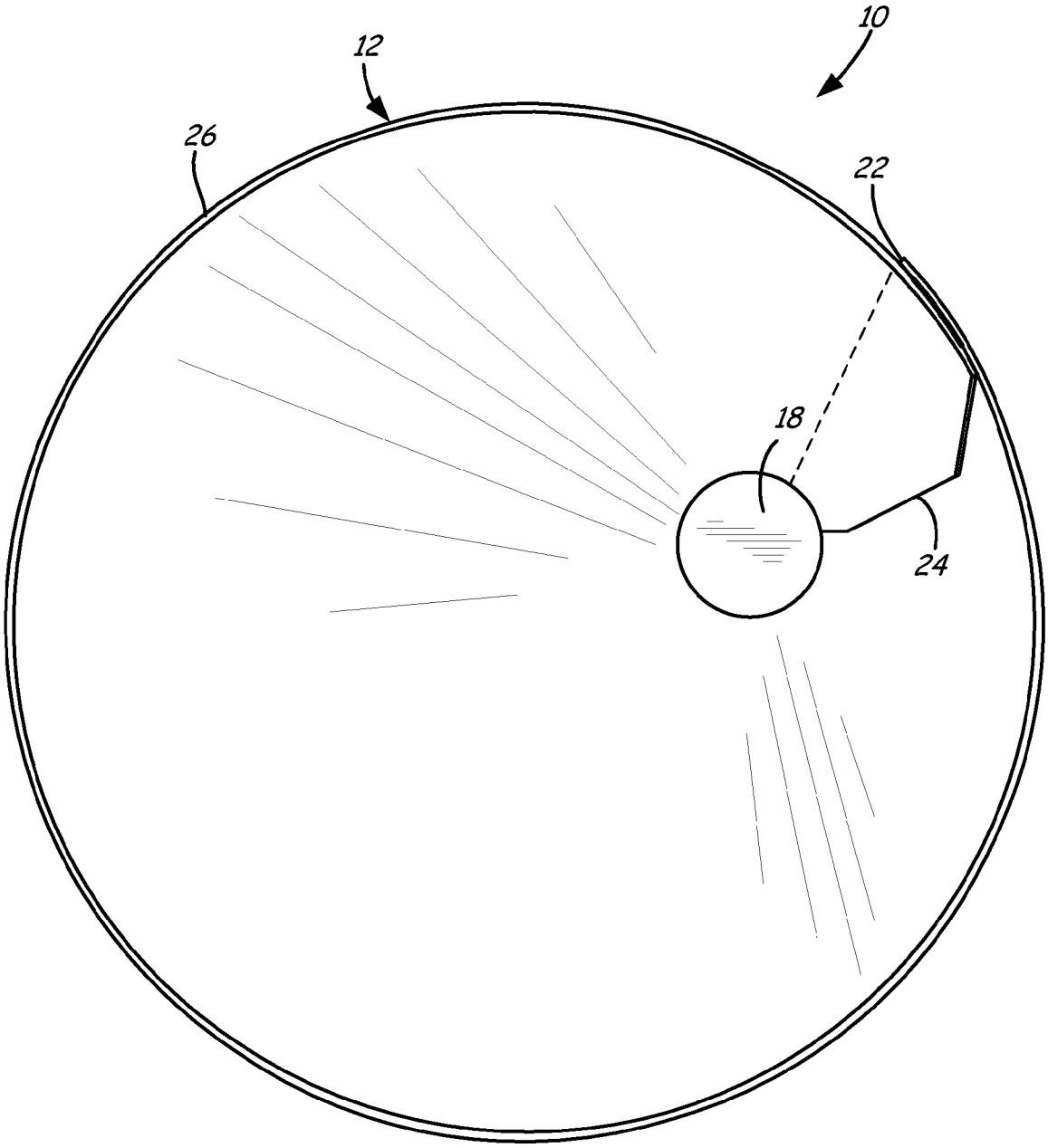
FIG. 5 is a perspective view of the interior of the container after assembly.

End cap 18 can assist in forming a bottom to container 10 for containing a food (or beverage if sealed properly) item within the container. FIG. 5 is an end view of container 10, showing the interior of the container through the large-diameter, open end 12. When container 10 is assembled as shown in FIG. 5, side edges 22 and 24 overlap one another to form a partial enclosure, and end cap 18 at least partially seals the bottom opening of the container.

When desired, the consumer can remove end cap 18 by punching-out, tearing or otherwise removing the end cap so that the remainder of container 10 can be used as a megaphone for cheering at an event, such as a baseball game. A perforation along breaks 44 can further assist in removing end cap 18, if desired.

All surfaces of container 10 can be used for advertising, keeping score of the event, collecting autographs, providing customers with coupons, etc. For example, end cap 18 can be utilized as a medallion with printed information and/or graphics so that the end cap can be saved as a souvenir or used as a coupon.

After assembly, a large number of containers 10 can be stacked compactly similar to beverage cups currently in use. This allows a large number of containers to be stacked together and shipped in a package. This also can be beneficial to concession operators that distribute the filled containers since the containers can be dispensed using the same dispensing methods currently used by concessionaires. I one example, the container can be constructed entirely of paper and a small amount of adhesive, which may be more environmentally friendly than the plastic with which current megaphones are typically constructed.

Although the present disclosure has been described with reference to one or more examples, workers skilled in the art will recognize that changes may be made in form and detail without departing from the scope of the disclosure and/or the appended claims.

What is claimed is:

1. A container comprising:

a first end, which is open to an interior of the container;

a second end, which has a smaller diameter than the first end;

a side wall having overlapping first and second side edges that are attached to one another;

a bridge positioned along the bottom edge opposite to the overlapping first and second side edges, wherein the bridge extends along only a portion of a circumference of the second end and is bent along a first break at the bottom edge; and an end cap, which has an outer diameter a diameter that is larger than an inner diameter surface of the side wall at the bottom edge and smaller than the inner diameter surface of the side wall at the top edge and frictionally engages the inner diameter surface of the side wall to at least partially seal the second end, wherein the end cap is vertically offset from the second end toward the first end, and is formed with the side wall as a single, continuous piece of material through the bridge without any further attachment to the side wall such that the endcap is removable from the side wall so the remainder of the popcorn cup may be usable as a megaphone, and wherein the bridge is further bent along a second break at the end cap and at least one of the first and second breaks is perforated.

2. The container of claim 1 wherein:

the first side edge has an outer surface, which is attached to an inner surface of the second side edge, relative to the interior; and the first side edge has a first cutout adjacent the bottom edge and a second cut-out adjacent the top edge, which allow the first and second side edges to be more easily overlapped.

3. The container of claim 1, wherein the side wall has a shape resembling a terminated cone.

4. The container of claim 1, wherein the first and second side edges are attached to one another with an adhesive.

5. The container of claim 1, wherein the container forms a megaphone popcorn cup.

6. A method comprising:

providing a container comprising:

a first end, which is open to an interior of the container;

a second end, which has a smaller diameter than the first end;

a side wall having overlapping first and second side edges that are attached to one another;

a bridge positioned along the bottom edge, wherein the bridge extends along only a portion of a circumference of the second end and is bent along a first break at the bottom edge; and an end cap, which has an outer diameter a diameter that is larger than an inner diameter surface of the side wall at the bottom edge and smaller than the inner diameter surface of the side wall at the top edge and frictionally engages the inner diameter surface of the side wall to at least partially seal the second end, wherein the end cap is vertically offset from the second end toward the first end, and is formed with the side wall as a single, continuous piece of material through the bridge without any further attachment to the side wall, and wherein the bridge is further bent along a second break at the end cap;

removing the endcap from the side wall; and using a remainder of container without the endcap as a megaphone.

7. The method of claim 6 and further comprising:

prior to removing the endcap, containing popcorn within the container.

* * * * *